United States Patent [19]

Dunst

[11] Patent Number: 4,458,960

[45] Date of Patent: Jul. 10, 1984

[54] ICE BODY SUPPLY DELIVERY CONTROL

[75] Inventor: Robert A. Dunst, White Bear Lake, Minn.

[73] Assignee: King-Seeley Thermos Co.

[21] Appl. No.: 373,842

[22] Filed: May 3, 1982

[51] Int. Cl.[3] ..... A47B 88/00; A47B 77/08

[52] U.S. Cl. ..... 312/138 A; 312/236; 312/311; 312/328; 294/55

[58] Field of Search ..... 312/138 A, 116, 118, 312/120, 311, 322, 323, 326, 327, 328, 271, 236; 62/344; 294/55

[56] References Cited

U.S. PATENT DOCUMENTS

| | | | |
|---|---|---|---|
| 583,652 | 6/1897 | Mulligan . | |
| 764,777 | 7/1904 | Slater | 312/311 |
| 918,297 | 4/1909 | Duffy | 312/311 |
| 1,258,520 | 3/1918 | Backermann | 312/328 |
| 1,402,602 | 1/1922 | Hansen . | |
| 1,582,703 | 4/1926 | Stryker | 312/118 |
| 1,716,883 | 6/1929 | Gesbeck | 312/328 |
| 2,136,558 | 11/1938 | Manshel | 312/138 A |
| 2,362,758 | 11/1944 | Marrow et al. | 312/328 |
| 2,405,668 | 8/1946 | Paxton et al. | 312/311 |
| 2,496,296 | 2/1950 | Lobl . | |
| 2,563,223 | 8/1951 | Dreher | 294/55 |
| 3,269,790 | 8/1966 | Cushing | 312/328 |
| 3,308,632 | 3/1967 | Winfield, Jr. . | |
| 3,425,765 | 2/1969 | Levy | 312/271 |
| 3,533,670 | 10/1970 | Karnikyan . | |
| 3,840,261 | 10/1974 | Fulkerson et al. | 294/55 |
| 3,880,485 | 4/1975 | Schmelzer | 312/236 |
| 4,087,140 | 5/1978 | Linstromberg | 62/344 |
| 4,098,094 | 7/1978 | Linstromberg | 312/311 |
| 4,269,039 | 5/1981 | Baker | 312/311 |

*Primary Examiner*—Victor N. Sakran

*Attorney, Agent, or Firm*—Harness, Dickey & Pierce

[57] ABSTRACT

An ice body supply delivery control for use in preventing undesirable spillage of ice bodies from a supply structure through an access opening thereof when the closure door thereof is pivoted downwardly to an open position. The supply structure includes an inner door in the form of a pivotally mounted baffle, which is movable with the door. A removable stop is provided on the baffle for cooperation therewith in controlling outward movement of the ice bodies upon opening of the door. In the illustrated embodiment, the stop is provided in the form of a scoop for handling ice bodies having a handle portion removably secured to the baffle. The baffle includes integral spring clip structure for holding the scoop handle removbly in association therewith. A tether may be provided for retaining the scoop in association with the apparatus. An indicium is provided on the baffle for indicating the disposition of the scoop in the secured arrangement thereon.

13 Claims, 6 Drawing Figures

FIG. 1
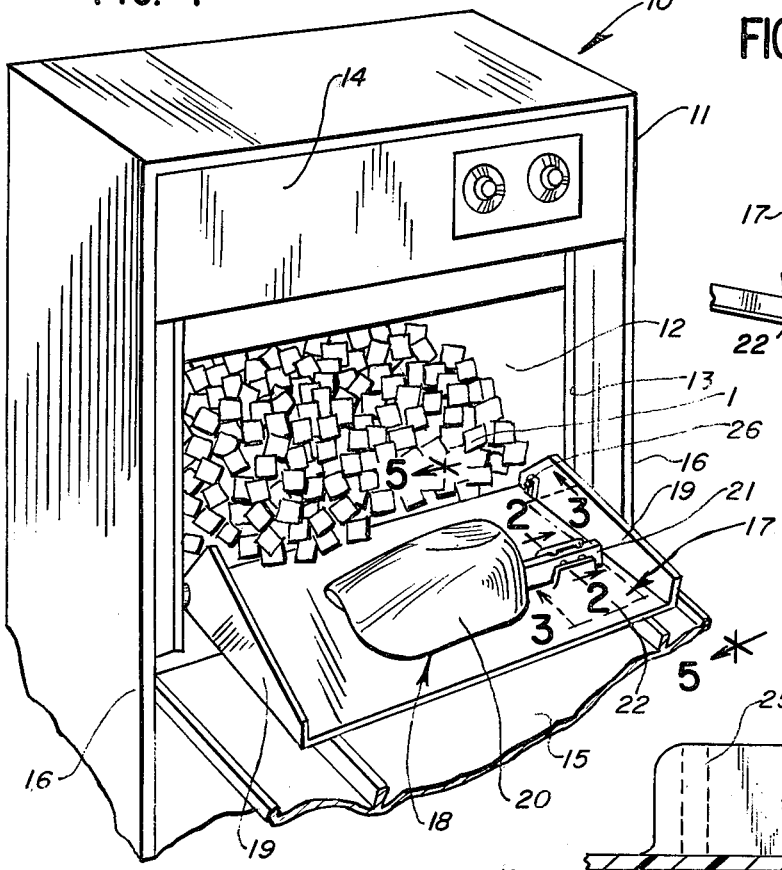
FIG. 5
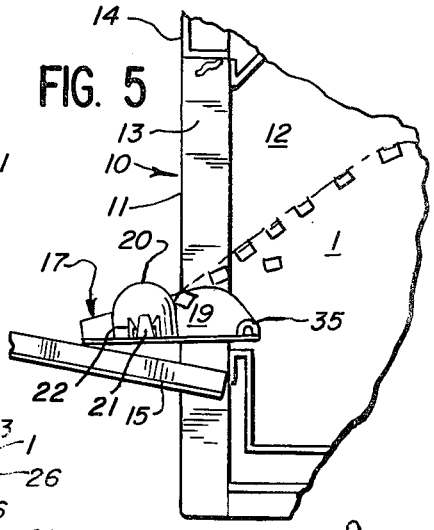
FIG. 3
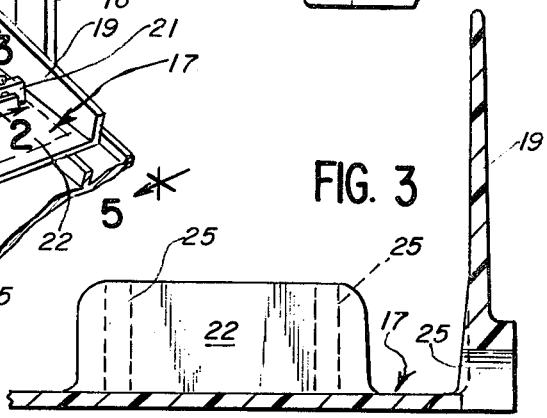
FIG. 4
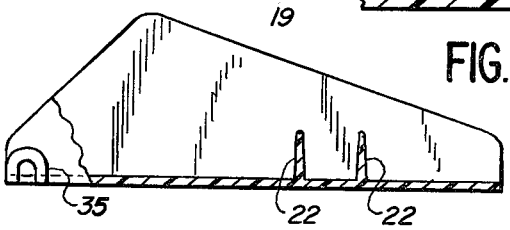
FIG. 2
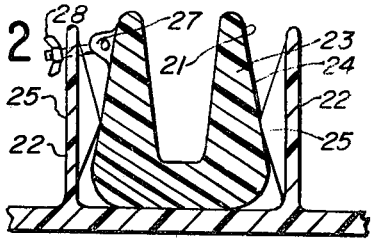
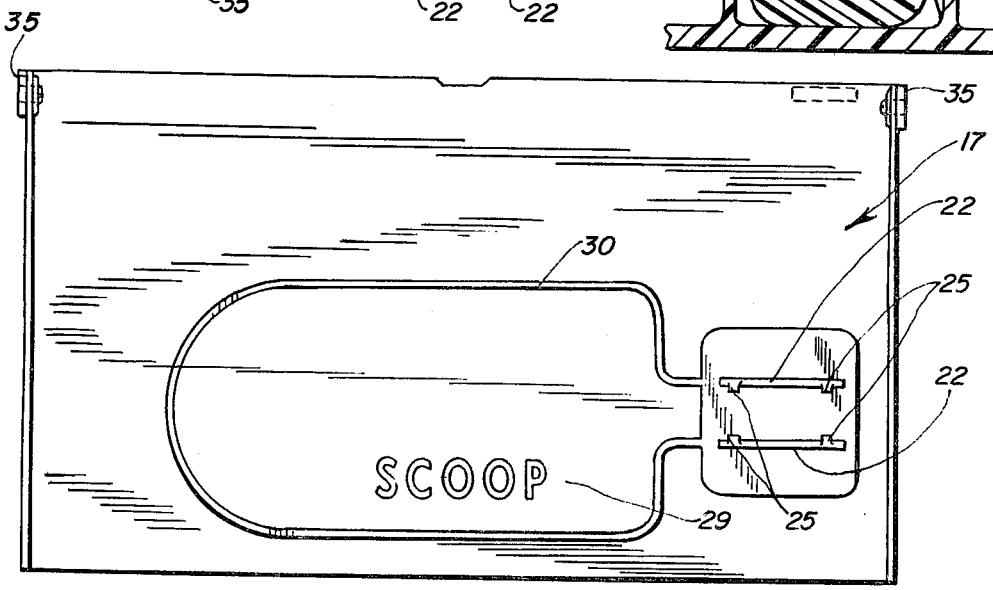
FIG. 6

ICE BODY SUPPLY DELIVERY CONTROL

BACKGROUND OF THE INVENTION

1. Field of the Invention

This invention relates to ice body supply apparatuses and in particular to means for controlling spillage of ice bodies from a supply housing upon opening of the access door to the ice body storage space.

2. Description of the Prior Art

In one known form of ice body supply apparatus, a retainer baffle is pivotally mounted to the housing inwardly of the tilt-down access door normally closing a vertically extending access opening in the housing wall. The tilt-down access door pivots about a horizontal axis adjacent its lower edge. The retainer baffle includes side flanges and functions to control the outward movement of ice bodies upon opening of the access door.

It is further conventional in such ice body supply apparatuses to provide a suitable scoop for use by a user in removing a desired quantity of ice bodies from the storage space through the access opening. A problem has arisen in the use of a conventional scoop in that the scoop is often unavailable when required, sometimes because it is lost or misplaced, or sometimes because it is buried within the ice bodies, requiring the user to search through the ice with his hands to find the scoop. Such action is considered unsanitary and undesirable.

A further problem arises in the use of the present baffle structure in that, at times, when the tilt-down access door is opened some of the ice may spill forwardly through the access opening over the approximately horizontally extending retainer baffle and the access door which supports its front edge, presenting an undesirable and unsanitary condition.

In U.S. Pat. No. 2,436,296 of Frederick Lobl, a portable refrigerated container is illustrated wherein eating utensils are stored on the inside of the cover by means of suitable retaining elements associated therewith.

In U.S. Pat. No. 3,308,632 of Howard E. Winfield, Jr., an ice maker with a door-mounted bin is disclosed wherein the bin is removably carried on support means on the inner surface of the door.

SUMMARY OF THE INVENTION

The present invention comprehends an improved ice body supply structure having improved means for handling ice bodies including means for preventing undesirable movement of ice bodies outwardly through an open door when it is swung to a horizontal position providing access to the ice storage space.

More specifically, in the illustrated embodiment, there is provided an ice body flow control means comprising a stop extending upwardly in the flow path of the ice bodies for effectively preventing movement of the ice bodies forwardly over a door surface beyond the stop.

In the illustrated embodiment, a stop is mounted to an improved baffle pivotally mounted to the housing of the ice body supply structure and which is movable with the door when the door is swung to the open position so as to permit full access to the storage space.

In the illustrated embodiment, the stop comprises a scoop removably mounted to the baffle.

The scoop is provided with a handle which is removably secured to the baffle.

The improved baffle is provided with means for releasably holding the scoop handle comprising integral clip means in the illustrated embodiment.

The improved baffle includes upwardly projecting side flanges cooperating with the scoop stop means in controlling the outward movement of ice bodies when the door is swung to the open horizontal position.

In one embodiment, the scoop is tethered to the door structure by a suitable flexible connector, and in the illustrated embodiment, the scoop is tethered to the baffle.

The invention further comprehends the provision of indicium on the door structure for indicating the disposition of the scoop in association therewith.

The ice body delivery control means of the present invention is extremely simple and economical of construction while yet providing a highly improved and sanitary structure as discussed above.

BRIEF DESCRIPTION OF THE DRAWING

Other features and advantages of the invention will be apparent from the following description taken in connection with the accompanying drawing wherein:

FIG. 1 is a fragmentary perspective view of an ice body supply structure having improved means for handling ice bodies embodying the invention;

FIG. 2 is a fragmentary enlarged vertical section taken substantially along the line 2—2 of FIG. 1;

FIG. 3 is a fragmentary enlarged vertical section taken substantially along the line 3—3 of FIG. 1;

FIG. 4 is a fragmentary side elevation of the baffle with a portion broken away to illustrate the arrangement of the ice body scoop retaining clips thereon;

FIG. 5 is a fragmentary side elevation of a left side wall portion of the ice storage bin of the structure of FIG. 1 with the access door shown in open position, the baffle supported by the access door, and the scoop retained on the baffle; and FIG. 6 is a plan view of the baffle illustrating the provision of indicium means thereon for indicating the disposition of the ice body scoop in the retained position on the baffle.

DESCRIPTION OF THE PREFERRED EMBODIMENT

In the exemplary embodiment of the invention as disclosed in the drawing, an ice body supply structure in the form of an automatic ice maker generally designated 10 is shown to include a housing 11 defining an ice body storage space in the form of a bin 12, access to which is provided through a front access opening 13 in the front wall 14 of the housing. A tilt-down access door 15 is pivotally mounted to the sidewall 16 of the housing to swing downwardly about a horizontal axis to an open position, as illustrated in FIG. 1, wherein the door extends generally horizontally.

An inner bin door in the form of a baffle 17 is pivotally mounted to the sidewall 16 inwardly of the access door 15, and the pivotal mounting of baffle 17 is such that baffle 17 also swings downwardly with the door 15 when the door 15 is moved to the open position to expose the ice bodies I in the storage bin 12 for removal by the user as desired.

As indicated briefly above, the invention comprehends the provision of ice body flow control means comprising stop means generally designated 18 cooperating with the door 15 and baffle 17 in controlling movement of the ice bodies I outwardly through the access opening when the door is moved to the open access-providing position illustrated in FIG. 1. As shown therein, the ice body stop means 18 extends transversely of the door to be disposed outwardly of the access opening and projecting upwardly into the path of ice bodies passing outwardly from the storage bin 12 through the access opening when the access door is moved to the access-providing, generally horizontal open position illustrated in FIG. 1. More specifically, the stop means 18 cooperates with the baffle means side flanges 19 in limiting movement of ice bodies outwardly from the access opening.

In the illustrated embodiment, the stop means 18 comprises a scoop having a scooping portion 20 and a handle portion 21. The scoop is removably retained in association with the door, and more specifically, in association with the baffle 17, by spring clips 22 formed integrally with the baffle. The stop means 18 may have any suitable desired transverse extent between the side flanges 19 of the baffle and, in the illustrated embodiment, extends somewhat less than fully transversely therebetween to permit facilitated mounting and removal of the scoop relative to the baffle in normal use.

As shown in FIG. 2, handle 21, in the illustrated embodiment, is defined by a resilient U-shaped cross section having legs 23 defined by outer converging surfaces 24. Springs clips 22 are provided with inwardly projecting wedge portions 25 for releasably frictionally engaging the handle surfaces 24.

Baffle 17 is pivotally mounted to the housing sidewalls 16 by means of U-shaped connecting portions 35 in the side flanges 19 cooperating with suitable inwardly extending pins 26 on the housing sidewalls 16.

As illustrated in FIG. 2, handle 21 may be provided with a boss 27. A leash 28 may be provided as desired for connection to one of the retaining clips 22 in retaining the scoop 18 in association with the apparatus, thus avoiding undesirable loss or displacement.

It is further desirable that the scoop 18 be replaced in retained association with the retaining clips 22 upon completion of the use thereof. It has been found that the provision of an indicium 29 identifying the location of the scoop has the salutary effect of increasing the tendency to return the scoop to the retained disposition illustrated in FIG. 1. As further shown in FIG. 5, the indicium 29 may include an outline 30 of the scoop configuration, further urging the user to properly return the scoop to the retained disposition of FIG. 1. When the scoop is disposed in the retained position of FIG. 1 and the door 15 is closed the scoop is maintained at the same temperature as the ice bodies I in the storage bin, minimizing ice melt when the scoop is used.

In the illustrated embodiment, the baffle 17 defines an inner door which swings out pivotally with the main door 15 when the main door is moved toward the full open position of FIG. 1, wherein the door 15 is disposed at an approximately 15° angle with the horizontal. The baffle may be formed by injection molding from a suitable synthetic resin, such as ABS plastic, providing suitable resilience in the integral spring clips 22 to maintain the scoop in association with the baffle, notwithstanding the slamming of the door to a closed position, as may occur in normal use.

The scoop illustratively is formed of polypropylene, providing improved accuracy in the formation thereof, and assuring maintained tightness of the handle portion with the spring clips for long, troublefree life.

By tethering the scoop to the door structure, the scoop may be readily reclaimed from the storage space in those instances where the previous user has inadvertently left the scoop therein, thus avoiding the need for a subsequent user to search through the stored ice in the storage space for the scoop, thereby providing improved sanitary use of the apparatus.

The foregoing disclosure of specific embodiments is illustrative of the broad inventive concepts comprehended by the invention.

I claim:

1. In an ice body supply structure having a housing defining an ice body storage space, a front access opening thereto, a door pivotally mounted to the housing adjacent the bottom of said access opening for selectively closing said access opening, and opening said access opening when said door is moved to an outwardly extending substantially horizontal position and baffle means inwardly of said door and movable therewith for controlling movement of ice bodies outwardly through said access opening when said door is moved to an opened position, the improvement comprising:

means carried by said baffle means defining an ice body stop extending transversely of said door disposed outwardly of said access opening and projecting upwardly into the path of said ice bodies passing outwardly from said space through said access opening when said door is in said opened position for cooperating with said baffle means in limiting movement of said ice bodies outwardly from said access opening upon opening of said door.

2. The ice body supply structure of claim 1 wherein means are provided for removably securing said stop to said baffle means.

3. The ice body supply structure of claim 1 wherein said stop extends somewhat less than the full transverse width of said door.

4. The ice body supply structure of claim 1 wherein means are provided for removably securing said stop in association with said baffle and said stop includes means for manual grasping thereof for removal from association with said baffle.

5. In an ice body supply structure having a housing defining an ice body storage space, a front access opening thereto, a door pivotally mounted to the housing adjacent the bottom of said access opening for selectively closing said access opening and opening said access opening when said door is moved to an outwardly extendingly substantially horizontal position, and a baffle means inwardly of said door and pivotally movable therewith for controlling movement of ice bodies outwardly through said access opening when said door is moved to an opened position, the improvement comprising:

means defining an ice body scoop mounted removably in association with the baffle means to extend transversely of said door disposed outwardly of said access opening and projecting upwardly into the path of said ice bodies passing outwardly from said space through said access opening when said door is in said opened position for cooperating with said baffle means in limiting movement of said ice bodies outwardly from said access opening upon opening of said door.

6. The ice body supply structure of claim 5 wherein said scoop is removably mounted to said baffle means, said baffle means is pivotally mounted to said housing, and said baffle means is swung to a position wherein said scoop is disposed within said storage space when the door is in the closed position.

7. The ice body supply structure of claim 5 wherein said scoop includes a handle removably secured to said baffle means.

8. The ice body supply structure of claim 5 wherein said baffle means is provided with spring clip means and said scoop includes a handle removably secured to said baffle means and spring clip means.

9. The ice body supply structure of claim 5 wherein said baffle means defines integral spring clip means and said scoop includes a handle removably secured to said baffle means and spring clip means.

10. The ice body supply structure of claim 5 wherein said scoop is formed of polypropylene synthetic resin.

11. The ice body supply structure of claim 5 wherein a leash is connected to said scoop in association with said supply structure for preventing removal of the scoop from association with the supply structure.

12. The ice body supply structure of claim 5 wherein indicium is provided in association with the door for indicating to the user the disposition of the scoop in replacement in association with the door.

13. The ice body supply structure of claim 5 wherein indicium is provided on the baffle means for indicating to the user the disposition of the scoop in replacement on the baffle means.

* * * * *